US006659868B2

(12) United States Patent
Stern

(10) Patent No.: US 6,659,868 B2
(45) Date of Patent: Dec. 9, 2003

(54) APPARATUS FOR AND METHOD OF PLAYING A DICE GAME

(76) Inventor: Max Stern, 6351 Chisos Dr., Las Vegas, NV (US) 89103

( * ) Notice: Subject to any disclaimer, the term of this patent is extended or adjusted under 35 U.S.C. 154(b) by 143 days.

(21) Appl. No.: 09/981,886

(22) Filed: Oct. 17, 2001

(65) Prior Publication Data

US 2002/0066998 A1 Jun. 6, 2002

Related U.S. Application Data

(60) Provisional application No. 60/241,021, filed on Oct. 17, 2000.

(51) Int. Cl.[7] ..... A63F 9/04; A63F 3/06

(52) U.S. Cl. ..... 463/20; 463/17; 463/18; 463/13; 273/138.2; 273/274; 273/144 A; 273/144 B; 273/146

(58) Field of Search ..... 463/17, 18, 19, 463/20, 22, 13; 273/138.2, 138.1, 139, 146, 143 R, 274, 144 A, 144 B

(56) References Cited

U.S. PATENT DOCUMENTS 2,985,453 A * 5/1961 Matisz ..... 273/144 B
4,533,143 A * 8/1985 Albright et al. ..... 273/144 B
5,265,881 A * 11/1993 Doherty ..... 273/274
5,791,649 A * 8/1998 DiSandro ..... 273/243
6,062,563 A * 5/2000 de Keller ..... 273/274
6,173,955 B1 * 1/2001 Perrie et al. ..... 273/146

FOREIGN PATENT DOCUMENTS

GB 2213070 * 9/1999 ..... 273/144 B

* cited by examiner

*Primary Examiner*—Benjamin H. Layno
(74) *Attorney, Agent, or Firm*—Jeffrey C. Maynard

(57) ABSTRACT

A method and apparatus for playing a dice game for one or more players. Dice are presented in a variety of colors. Players can bet on obtaining predetermined combination of dice with respect to color and number. A predetermined number of dice are provided for each player. Players are permitted to reject some or all dice and receive substitute dice to complete a final combination of dice. The final combination is evaluated against a predetermined pay table of values to determine the pay out, if any, to the player. Apparatus may include electronic or mechanical game machines.

16 Claims, 5 Drawing Sheets

APPARATUS FOR AND METHOD OF PLAYING A DICE GAME

This Application claims the benefit of U.S. Provisional Application, Ser. No. 60/241,021 entitled Apparatus for and Method of Playing a Dice Game, filed with the U.S. Patent and Trademark Office on Oct. 17, 2000.

BACKGROUND OF THE INVENTION

Field of the Invention

The present invention relates to new casino games, and more particularly to dice games intended to be played in gambling casinos. In its more particular embodiments, the present teachings specifically pertain to a gambling game utilizing a plurality of dice, in which a participant attempts to achieve a particular winning combination of subsets of the dice, relying on observations, luck, and skill in his or her selection for each individual game. The game is enabled, in particular, for video gambling machines, computer games, or other electronic or mechanical devices.

BACKGROUND OF THE PRIOR ART

Dice games are predominantly games of chance in which winning or losing depends on the random chance of a certain dice combination being turned rather than the skill of the player. Dice games, old and new, are abundant. Numerous dice games are known in the prior art.

Virtually all casinos, especially those in the gaming capitals of the world, have board games that are played for gambling purposes. The oldest and most popular board games involve the use of dice to determine the outcome of wagers. Of these games, the most popular and well known is the game of craps. Craps is an exciting dice game well known by name by many persons. The Encarta Encyclopedia calls craps "(t)he most popular dice game in the U.S." Its rules of play, however, are not so well known nor can they be. The rules of play are complex generally and vary widely among the sites that offer the game, and among locales.

The game of craps presents various betting schemes that appear complicated to the uninitiated and the speed of play intimidates the beginner. As a result, craps has a reputation of being difficult to learn and play. Moreover, although craps is generally perceived to be exciting and attractive, many casino patrons are intimidated and discouraged from playing.

The basic elements of the play of craps have many variations. The probability that a given outcome of the throw of dice will be a winning combination varies as a function of the player's 'point,' which again varies during the play. The actual rules of play are not widely known not only because of the many variations but also because of the vast memorization of the outcomes and their relationships. Although craps is a popular table game, there are relatively few wagering options, and even these few options are not intuitively obvious nor readily apparent to the casual observer. Furthermore, the payoffs and odds of success are not generally known to the betting public, not easily discernable from observing the game, and gambling is thereby discouraged. The pace at which craps is played is intimidating, leaving little opportunity for the novice player to acquire knowledge of the game. Many novice players are reluctant to attempt the game as a result of the confusion of various rules and onerous effort required to understand the risks. Consequently, the number of players who play craps has declined over the years, and is likely to so continue.

Due to the complexity involved in playing the popular wagering games employing dice, as exemplified by the brief summary of craps given above, there is a need for a simpler game of chance that will appease all strata of expertise in the art of gambling, yet remain challenging and enjoyable.

Single player electronic video games have been developed to permit players of all skill levels to enjoy the same types of games of chance while affording an opportunity to wager.

For example, electronic video poker games have been prevalent in gaming casinos for many years. The electronic video poker gaming machine is designed to replicate the play of a hand of poker. Typically, a player is not playing against any other players or against a dealer's hand; the player is simply attempting to achieve the highest-ranking poker hand possible from the cards displayed to the player.

Video poker is generally played on an electronic video gaming machine that uses a video screen display to show cards to a player. A gaming computer electronically shuffles the deck of cards, activates the dealing sequence in response to input by a player, causes the cards to be displayed on the video screen display, and analyzes the hand to determine winning and losing hands. Computer controls also affect payouts to the player based on the amount of the player's wager and the poker ranking of the hand.

The higher the poker hand achieved by the player, the greater the player's winnings based on the number of coins, tokens or credits wagered by the player. Typically, a payout schedule is posted on the gaming machine to advise the player of the payoffs available for certain winning card combinations.

Despite the popularity of craps and similar games of chance involving dice, these games present several disadvantages to the casinos and players alike. Furthermore, players have become bored with traditional video poker. Players prefer to play machines that have pay tables with high payouts for the types of winning combinations that are achievable. Gaming casino operators are desirous of having different types of electronic video games to offer to players.

Although there have been attempts to improve upon existing games and to develop new games of chance, there exists a need for a game that more closely meets the player's needs for excitement, risk, risk management, quickly and easily understood play, and possibility of success. At the same time, the game must meet the casinos' prerequisite for profitability from the use of the game.

A need exists for a wagering game employing dice or their electronic equivalent that is intended to be played in gambling casinos, that is simple to learn and play, and that results in increased revenues for the casino. There is a need for new video gaming machines that are capable of encouraging a high volume of play while at the same time offering what the players consider to be good pay tables. There is a need to provide new and interesting electronic video games that attract players and that can increase the volume of wagering in each gaming machine.

The present invention fulfills these needs. It is a fast paced game of simple consistent rules, player participation, choices of risk offered by a variety methods of placing wagers, and corresponding to varying pay-out. The house edge is fairly derived and players will detect this fairness through the payout odds. These features will increase the number of players to the game, both experienced and inexperienced players, generating satisfaction in the players and profitability to the casino.

SUMMARY OF THE INVENTION

An object of the present invention is straightforward entertainment with some of the skill, guess and atmosphere of a casino.

Another object is to enable implementation of a novel dice game by a gaming establishment, such as a casino, which supervises and controls the flow of the game for a predetermined, but non-participatory, fee.

Another object is implementation of supervision and control of the flow of a game by software, or by gaming establishment personnel.

Another object is to promptly provide visible winning results, solely for entertainment purposes, or additionally for wagering, such that a casino atmosphere of chance is available for a single, or for a plurality of participants.

A further object is to enable adaptation of the invention to usage independent of a gaming establishment, including individual personal usage.

It is an object of the present invention to provide an enjoyable dice game.

It is a further object of the present invention to provide a dice game that will be easy for players to learn.

It is a still further object of the invention to provide a video gaming machine apparatus, which displays a new and interesting dice game that encourages a high amount of individual player interest while maintaining acceptable payback percentages.

The goal of the game is to play skillfully with dice by taking advantage of an opportunity to hold some, or all dice, or exchange for additional dice. A player can achieve a winning combination of dice according to a defined table of values. If the final combination of dice contains a winning combination, the player receives payment on his wager according to the table of values. If the final combination of dice does not contain any winning combination according to the table of values, that player loses his wager.

Whether solely for amusement or for entertainment with wagering, an electronic video game machine can be used. Dice can be displayed in an electronic or other machine play apparatus.

Among the advantages of the invention are the simplicity of play and ease of administration. This invention provides a novel game that is easy to administer and fun to play.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following detailed description, which should be read in conjunction with the accompanying drawings in which like reference numbers are used for like parts. This detailed description of an embodiment, set out below to enable one to build and use an implementation of the invention, is not intended to limit the enumerated claims, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

Play of the novel game disclosed herein involves a predetermined plural number of sets of dice. It may be played with traditional hexahedral cubes, each of the six sides having a different member of one or more sets of six indicia, numbers, letters, or other symbols, such as a different number of spots on each side to represent the integers from one to six, inclusive. Other shapes of dice presenting at least four sides may also be used. Each die in a particular set, as later described, should be identical to the other dice in that set.

In a preferred embodiment, ninety conventional cubes (six-sided dice) having indicia on the faces thereof representing the numbers 1 thru 6 respectively are provided for play. The ninety dice are subdivided into three sets having thirty dice per set. The dice, however, are not all the same color. One set of thirty dice is red, one set of thirty dice is green, and one set of thirty dice is blue. The combination of three such sets constitutes one unit of ninety dice. Although the games are designed to be played with three sets of different colored dice (one unit), the games can be played by using as many units, complete or incomplete, as desired.

For the media chosen for the production of this invention, a mechanical equivalent for dice could be employed. In a variant of the invention, electronic dice may be used instead of physical elements generally referred to as dice. Electronic dice are understood to be random number generators that each randomly display with equal likelihood one of n possible outcomes (n being the number of sides of the die). Thus, the displays represent a realistic simulation of actually rolling dice. Throughout the remainder of this disclosure, the term dice shall be taken to mean either physical or electronic dice.

Figure 1:
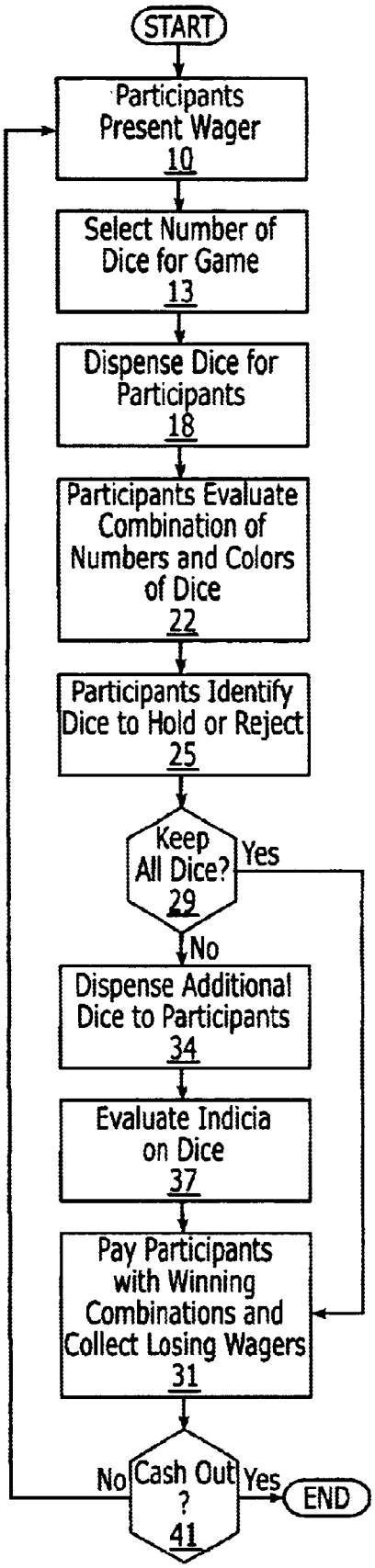
FIG. 1 is a flow chart illustrating steps of a specific embodiment of the invention.

Referring to a specific embodiment, further shown and described in more detail in relation to the drawings, FIG. 1 represents the sequence of steps establishing and carrying out a specific embodiment of the method of the invention.

In the first step, at station 10, a player presents a wager, signifying an ante or cost to participate. For play of the game, each player selects a quantitatively fixed wager for every game. The amount of the wager may not be increased or decreased during the later-described stages of the invention, as the game is being played. The host establishment can prescribe a minimum and maximum wager for each individual game. (The apparatus for home game play enables selective determination if wagering is to be involved.) Such a quantitatively fixed wager is made for each 'hand', if that participant selects to play more than one 'hand'. A minimum and maximum for competitive wagering can be prescribed for an individual round. Present concepts can provide for handling differing wagering amounts for one or more participants. In a specific embodiment, the host establishment can require an entry fee for participation in the game as well as a wager for each game. Personal wagering is estimated based on factors including experience in obtaining one or more 'hands' with a winning combination of dice in the type of game to be played, after dice have been dispensed. Payout for winning combinations may be dependent upon the amount of the wager.

In the second step, depicted at station 13, the number of dice for a game is selected. In a preferred embodiment, a game is played using five dice in an initial 'hand'. Alternate embodiments can be played using three, four or more dice.

In the third step, at station 18, the selected number of dice is displayed for the player. In one embodiment, five of the ninety dice are dispensed for such player. The probability that any particular die is presented is 1:90; the probability that any particular die will be a selected color is 1:3; the probability that the presented die will display any particular number is 1:6.

In the fourth step, at station 22, the player evaluates the combination of dice dispensed for that player against a selected table of values, such as shown in TABLE I, for each combination of dice in the game. Combinations depend on the indicated number and color of each die.

In the fifth step, represented by reference number 25, the player can reject from zero to all of the original dice received; or, such player can keep all the dice or change some, or all, of the dice. A player decides which, if any, dice should be kept or rejected, depending on his or her skill, expertise, and risk acceptance.

If the player elects to keep all the dice in the original combination (presumably a winning combination), represented by reference 29, the player is rewarded for the combination of dice according to the payout table for the selected game, as indicated at station 31.

Otherwise, additional chance dice are selectively distributed from the remaining dice in the initial unit to the player, indicated by station 34, in accordance with the number of dice rejected by the player in the fifth step (station 25).

In the next step, at station 37, the new combination of dice 'held' by the player is evaluated against a predetermined pay table. A ranking for each 'hand' displayed is evaluated according to preselected ranking, such as shown in TABLE I. With completion of respective changes, the round is complete and the player wins or loses more or less than that player's original wager, according to the game played.

In the next step, indicated by station 31, each player with a winning combination of dice, which player has not been previously rewarded, is paid according to the rank for each such winning 'hand'. A player with a winning combination of dice is paid on his wager, according to the scale of values of the game, such as shown in TABLE I. A player without a winning combination of dice, according to the scale of values, loses his or her wager.

The final step, indicated by station 41, is where the player decides whether to continue playing or to withdraw his or her winnings, if any. If the player chooses to play again, such player presents a wager, at station 10 and proceeds through the method steps again.

The method disclosed herein can be played with physical dice. In a preferred embodiment, however, an electronic video game machine that does not compete against the player controls the game. The steps and functions of a controller are established by software and take place electronically in video games to provide and distribute electronic designations of game dice, to maintain control of play of the game for plural players, and to sequence the steps of the game properly, while providing for selections made by a player, or players. Such game controller is also responsible for collecting wagers that are lost and making payments to winners, according to the pay table. The electronic video game machine provides functions to randomize the dice according to color and number, to distribute the dice to a player, or players, and to keep control and order to the steps of the game. The electronic video game machine automatically collects the wagers from the losers and makes payments to the winners.

An electronic video gaming machine upon which the method of the present invention can be practiced is well known in the art. The gaming machine includes a video display screen, a coin slot into which players may introduce coins or tokens and may also include a bill acceptor into which players may introduce paper currency, all of which are conventional in electronic video gaming machines.

As is also conventional, buttons are provided by which a player operates the gaming machine to cause electronic representations of dice to be displayed, held and rejected. A cash out button is also provided to cause any credits accrued to be cashed out by the player. Instead of using buttons to operate the gaming machine, conventional touch screen technology can also be used. Any suitable electronic video gaming machine can be modified so that the method of the present invention can be practiced thereon.

Fundamental concepts of the invention are explained in relation to a preferred embodiment in an electronic video gaming machine based on use of three sets of dice; that is one unit, for example, thirty (30) cubic red dice with faces numbered one (1) to six (6) inclusive, thirty (30) cubic green dice with faces numbered one (1) to six (6) inclusive, and thirty (30) cubic blue dice with faces numbered one (1) to six (6) inclusive are used.

Figure 2:
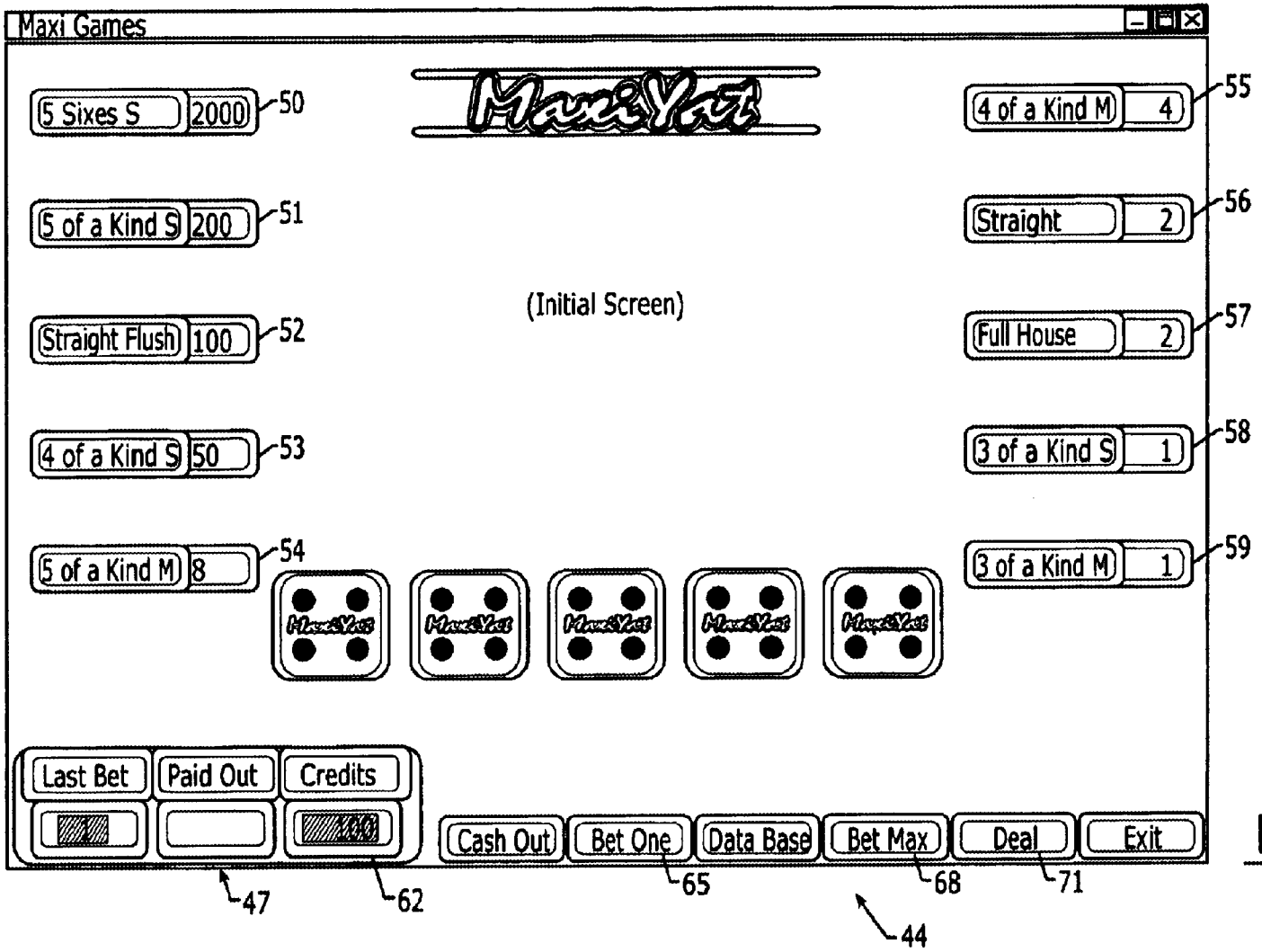
FIG. 2 shows a front elevational view of an electronic video gaming machine display for describing specific steps of one embodiment of the present invention.

Referring now to FIG. 2, there is presented a video screen display 44 for an exemplary embodiment of the present invention. The display screen 44 is sized to display five playing dice as well as an area to display wagers and credits 47 and indications of values for winning combinations of dice 50, 51, 52, 53, 54, 55, 56, 57, 58, 59, such values as shown in TABLE I. The player introduces coins or gaming tokens into a coin slot or paper currency into a bill acceptor to activate the gaming machine. Any coin, token, or value from paper currency introduced into the electronic video game machine is indicated as credits in window 62 on video screen 44. The player indicates the desired number of coins, tokens or credits to wager using touch-sensitive button 65. The player can wager the entire amount of available credits by using touch-sensitive button 68. To cause the initial deal of dice to be displayed on the video screen, the player activates the random number generator within the gaming machine by pressing touch-sensitive "Deal" button 71 on screen 44.

In a preferred embodiment of the present invention, five dice from a single unit of ninety dice are displayed on video screen 44. In an alternate embodiment, additional complete or incomplete units may be used. In a further embodiment, 3, 4 or more dice may be displayed.

Figure 3:
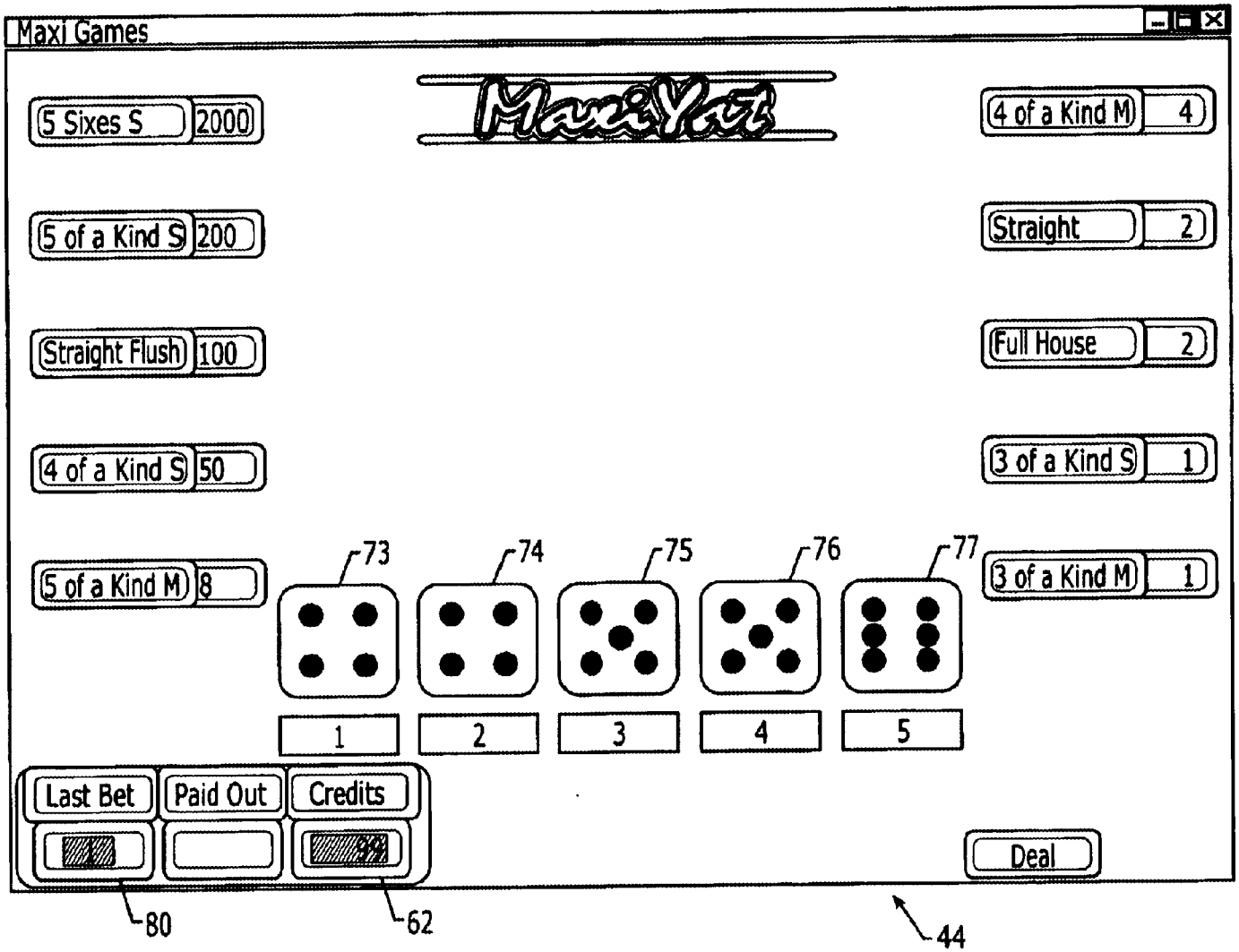
FIG. 3 shows a front elevational view of an electronic video gaming machine display for describing additional steps of one embodiment of the present invention.

In the example shown in FIG. 3, the player is dealt one die indicating a red 4 (73), one die indicating a blue 4 (74), one die indicating a red 5 (75), one die indicating a blue (76), and one die indicating a red 6 (77). Any coins, tokens, or value from paper currency introduced in excess of the amount the player wishes to wager are accrued as credits shown window 62. Controls in the electronic video machine automatically maintain accounting of the value of credits expended. The amount of the last wager is also displayed at 80. The player then selects which of the initial five dice the player wishes to hold by pressing the video screen 44 at the location of the die the player wishes to hold.

In this example, the player chooses to hold the die indicating a red 5 (75) and the die indicating a blue 5 (76). The remaining dice are rejected; that is, the die indicating a red 4 (73), the die indicating a blue 4 (74), and the die indicating a red 6 (77).

Figure 4:
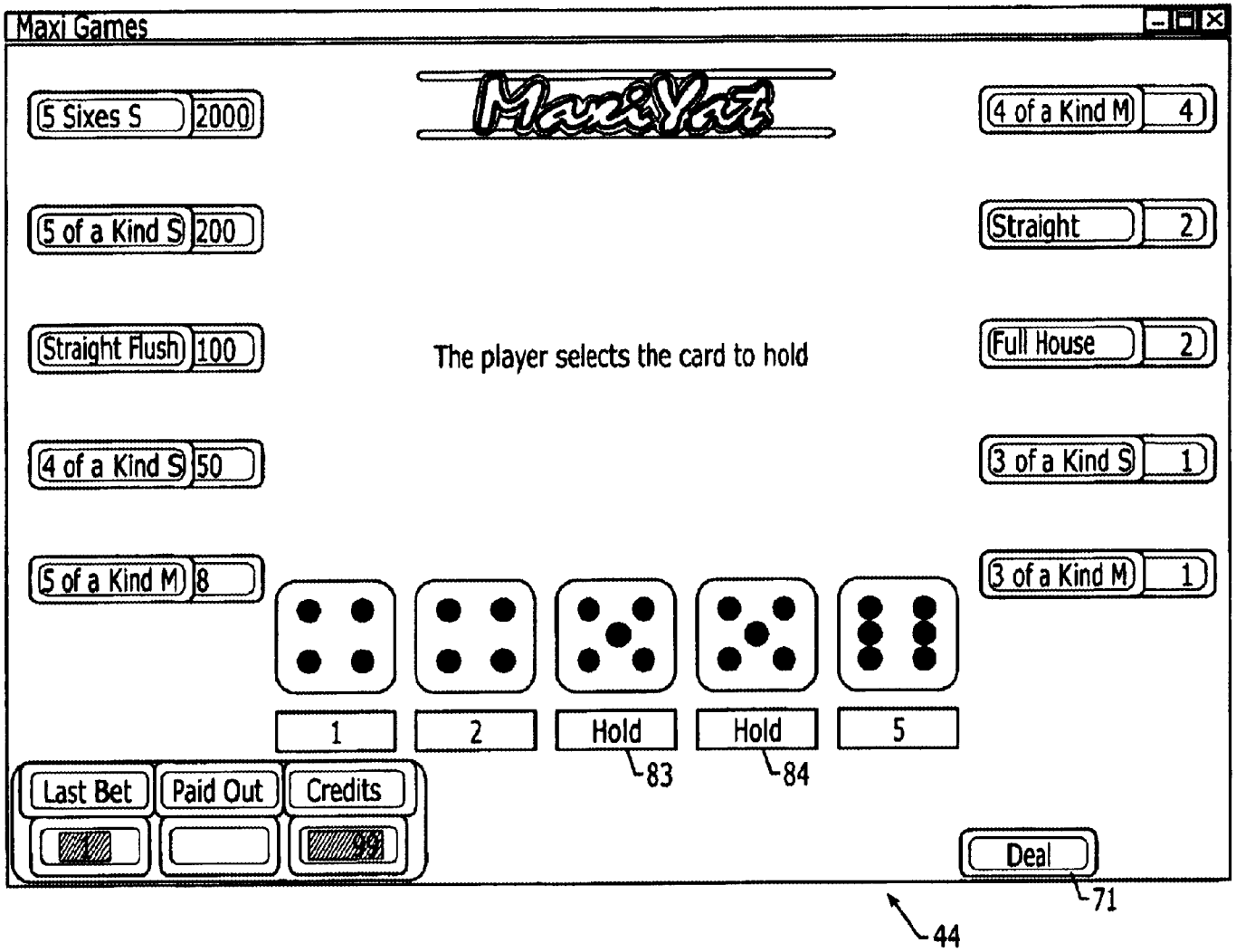
FIG. 4 shows a front elevational view of an electronic video gaming machine display for describing additional steps of one embodiment of the present invention.

FIG. 4 shows an example of the video screen display 44 after the player has selected which dice to hold from the initial display, as indicated by hold buttons 83 and 84. The player presses Deal button 71 to cause replacement dice from the original remaining unit of dice to be displayed on video screen 44.

Figure 5:
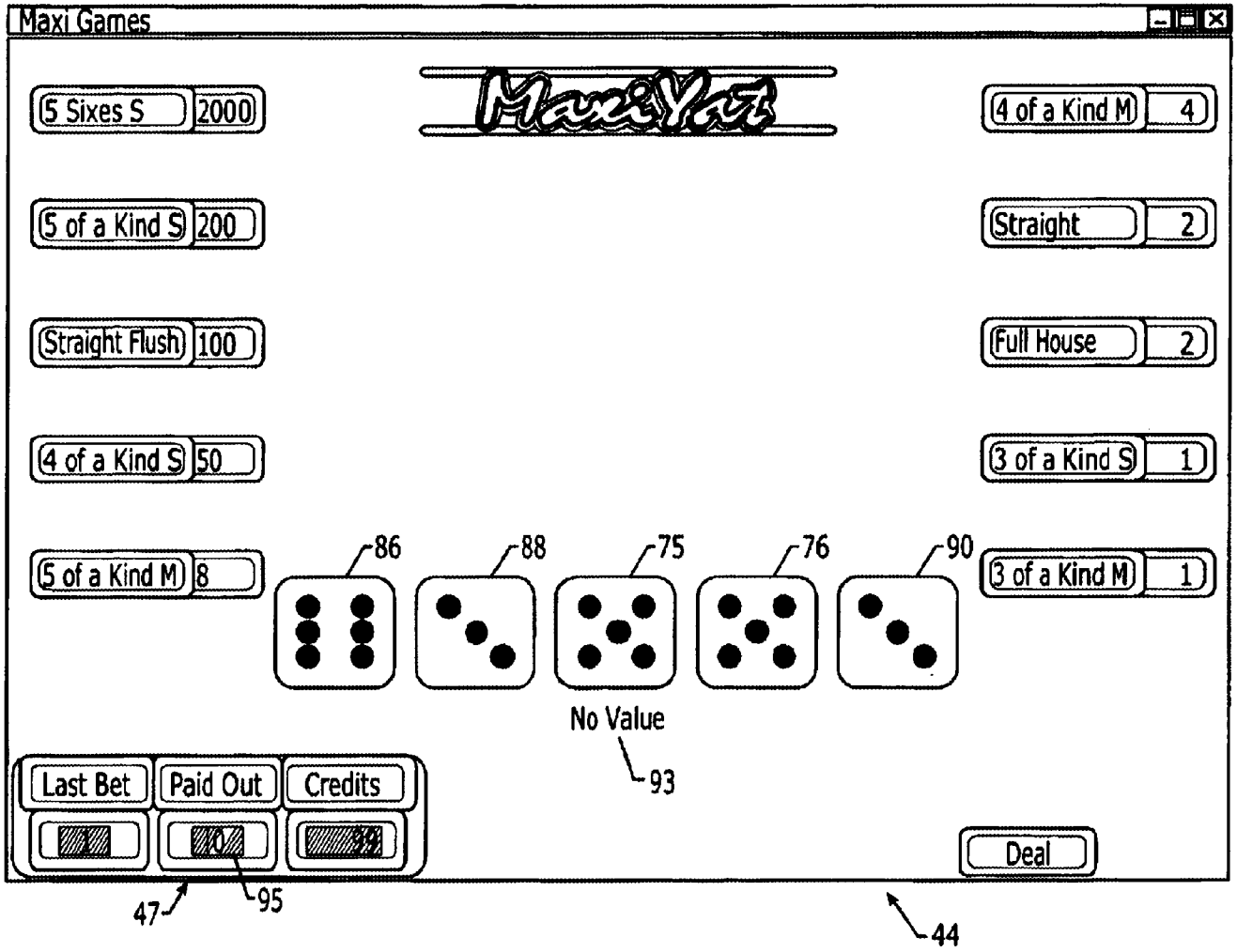
FIG. 5 shows a front elevational view of an electronic video gaming machine display for describing additional steps of one embodiment of the present invention.

In the example, FIG. 5, the player receives one die indicating a blue 6 (86), one die indicating a blue 3 (88), and one die indicating a green 3 (90) as replacement dice to combine with the red 5 (75) and blue 5 (76).

In the final combination, the player does not have a winning combination, as indicated at 93. Since the final combination has no value according to a predetermined payout table of values, such as TABLE I, the player loses his wager.

Had the final combination been a winning combination, the amount that the player wins is displayed on screen 44 in display area 47 at reference number 95 and is based on the ranking of the 'hand' achieved by the player and the amount wagered by the player. If a player's final 'hand' contains a winning combination of dice, the player receives payment on his or her wager. If a player's final 'hand' does not contain a winning combination of dice, that player loses his or her wager.

As can be seen from the description of the embodiments, the present invention is readily adaptable to play on a computer or video game. A person skilled in the art of computer and video game construction, as well as those skilled in other arts, will incorporate the method and conduct of this invention in such computer and video games.

A preferred embodiment of the invention comprises a video dice game, for an individual player, wherein the apparatus methodology comprises the steps of:

a) machine acceptance from the game player of an initial "bet" wager via a coin or token entry slot of the machine or from the player's machine credit bank;

b) machine random selection and video display of five dice to the player from the electronic bank of:
   i) thirty (30) red dice with faces numbered one (1) to six (6) inclusive;
   ii) thirty (30) green dice with faces numbered one (1) to six (6) inclusive; and
   iii) thirty (30) blue dice with faces numbered one (1) to six (6) inclusive;

c) permitting the player, after viewing his or her displayed 'hand', via appropriate machine control buttons, to either: stand on the 'hand' as dealt, or reject one or more of the original dice with replacement of such rejected dice with machine dealt dice;

d) machine random dealing from the remainder of the bank and video display of replacement dice in a final 'hand'; and e) machine evaluation of the player's final 'hand' with respect to the pay table of winning hands for the disclosed video game of the machine and pay-off to the player's machine credit bank of an appropriate amount of coins or tokens for a winning 'hand' according to the pay table of winning hands as related to the number of coins or tokens wagered.

The game is preferably played in video game machines, mechanical game machines, computers, and hand-held, mechanical or video game devices. An electronic video game machine can enable a single player to play more than one 'hand' at a time and can be used to accommodate plural players.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein. Therefore, for purposes of determining the scope of patent protection, reference shall be made to the appended claims in combination with the above detailed description.

TABLE I

| Relative Ranking of Winning Combinations and Prizes | |
|---|---|
| Five Sixes<br>(5 6s of same color) | 2000 |
| Five of a Kind<br>(any 5 dice of same value and same color) | 200 |
| Straight Flush<br>(any 5 sequential dice of same color) | 100 |
| Four of a Kind<br>(any 4 dice of same value and same color) | 50 |
| Five of a Kind (mixed)<br>(any 5 dice of same value) | 8 |
| Four of a Kind (mixed)<br>(any 4 dice of same value) | 4 |
| Straight<br>(any 5 sequential dice of different color) | 2 |
| Full House<br>(any 3 dice of same value and 2 other dice of same value) | 2 |
| Three of a Kind<br>(any 3 dice of same value and same color) | 1 |
| Three of a Kind (mixed)<br>(any 3 dice of same value) | 1 |

What is claimed is:

1. Method of conducting a dice game for one or more players, comprising the steps of:

(A) providing plural sets of dice for such game in which the dice include:
   (i) a plurality of surface areas with playing indicia thereon on each face of the dice, and in which
   (ii) each such set of dice includes a selected coloring distinguishing each set of dice;

(B) providing a table of values for color and indicia combinations of dice;

(C) randomly selecting and distributing from the plural set of dice, a selected number of dice to each player, with each player receiving the same number of dice;

(D) enabling each player to evaluate the color and indicia combination of such received dice based on such table of values to elect whether or not to reject one or more dice;

(E) permitting each player to selectively reject from zero to all dice obtained in Step (C);

(F) randomly selecting and distributing additional new dice from the plural set of dice, to each player corresponding to the number of dice, if any, rejected in Step (E); and (G) evaluating the color and indicia combination of dice held by each player against such table of values.

2. The method of claim 1, in which the number of sets of dice is at least three.

3. The method of claim 2, in which the color of individual sets of dice is selected from the group consisting of red, blue, green, yellow, orange, black, and white.

4. The method of claim 3, in which the number of surface areas with playing indicia thereon is at least four.

5. The method of claim 4, in which such playing indicia identify the face of such die with a different one of the numbers that comprise representations of numerals sequentially numbered from 1 to the number of surfaces, inclusive.

6. The method of claim 5, in which the number of dice distributed to each player, is selected from the group consisting of three, four and five.

7. The method of claim 6, in which the number of surface areas with playing indicia thereon is six.

8. The method of claim 7, in which such playing indicia identify the face of such die with a different one of the numbers that comprise representations of numerals sequentially numbered from 1 to 6, inclusive.

9. The method of claim 6, further comprising the steps of:

(H) permitting each player to place a wager at the beginning of the game; and (I) paying each player having a winning combination of contest elements, as determined by the table of values according to the player's wager.

10. The method of claim 9, in which the number of surface areas with playing indicia thereon is six.

11. The method of claim 10, in which such playing indicia identify the face of such die with a different one of the numbers that comprise representations of numerals sequentially numbered from 1 to 6, inclusive.

12. A device for playing a game according to claim 6 selected from the group consisting of:

a) electronic video game machines;

b) mechanical game machines;

c) computers;

d) hand-held mechanical devices; and e) hand-held video devices.

13. A device for playing a game according to claim 8 selected from the group consisting of:

a) electronic video game machines;

b) mechanical game machines;

c) computers;

d) hand-held mechanical devices; and e) hand-held video devices.

14. A device for playing a game according to claim 9 selected from the group consisting of:

a) electronic video game machines;

b) mechanical game machines;

c) computers;

d) hand-held mechanical devices; and e) hand-held video devices.

15. A device for playing a game according to claim 11 selected from the group consisting of:

a) electronic video game machines;

b) mechanical game machines;

c) computers;

d) hand-held mechanical devices; and e) hand-held video devices.

16. Method of conducting a dice game for one or more players, comprising the steps of:

(A) providing three sets of six-sided dice in which:

(i) playing indicia identify each face of the dice with a different one of the numbers that comprise representations of numerals sequentially numbered from 1 to 6, inclusive; and (ii) each such set of dice includes thirty dice of a selected coloring distinguishing each set of dice; coloring selected from the group consisting of red, blue, green, yellow, orange, black, and white;

(B) providing a table of values for color and indicia combinations of dice;

(C) permitting each player to place a wager at the beginning of the game;

(D) randomly selecting and distributing from the three sets of dice, five dice to each player;

(E) enabling each player to evaluate the color and indicia combination of such received dice based on such table of values to elect whether or not to reject one or more dice;

(F) permitting each player to selectively reject from zero to all dice obtained in Step (D);

(G) randomly selecting and distributing from the three sets of dice, additional new dice to each player corresponding to the number of dice, if any, rejected in Step (F);

(H) evaluating the combination of dice held by each player against such table of values; and (I) paying each player having a winning combination of contest elements, as determined by the table of values according to the player's wager.

* * * * *